US011547950B2

(12) United States Patent
Michaels

(10) Patent No.: US 11,547,950 B2
(45) Date of Patent: Jan. 10, 2023

(54) RESETTABLE BREAKAWAY APPARATUS

(71) Applicant: Danny Linn Michaels, Longmont, CO (US)

(72) Inventor: Danny Linn Michaels, Longmont, CO (US)

( * ) Notice: Subject to any disclaimer, the term of this patent is extended or adjusted under 35 U.S.C. 154(b) by 196 days.

(21) Appl. No.: 16/863,497

(22) Filed: Apr. 30, 2020

(65) Prior Publication Data

US 2020/0368636 A1 Nov. 26, 2020

Related U.S. Application Data

(60) Provisional application No. 62/851,764, filed on May 23, 2019.

(51) Int. Cl.
*A63K 3/04* (2006.01)

(52) U.S. Cl.
CPC ..... *A63K 3/046* (2013.01); *A63K 3/043* (2013.01)

(58) Field of Classification Search
CPC ..... A63K 3/046; A63K 3/043; A63K 3/04; A63K 3/00
USPC ..... 119/705; 482/16, 17
See application file for complete search history.

(56) References Cited

U.S. PATENT DOCUMENTS 1,146,843 A * 7/1915 Brown ..... A63B 5/02 482/17
1,561,186 A * 11/1925 Reach ..... A63K 3/043 482/17
1,902,995 A * 3/1933 Flynn ..... A63K 3/046 250/221
2,583,786 A * 1/1952 Marzucco ..... A63K 3/043 16/199
3,362,738 A * 1/1968 Dygert ..... A47B 57/485 403/328
3,384,367 A * 5/1968 Baum ..... A63K 3/043 482/17
4,368,875 A * 1/1983 Weiss ..... A63K 3/046 482/16
4,749,187 A * 6/1988 Dellinger ..... A63K 3/043 482/17
5,867,877 A * 2/1999 Patterson ..... F16G 11/101 24/598.5
6,063,005 A 5/2000 Schwartz
7,325,279 B2 * 2/2008 Huang ..... E06B 9/326 24/115 F (Continued)

*Primary Examiner* — Yvonne R Abbott-Lewis
(74) *Attorney, Agent, or Firm* — Patentfile, LLC; Bradley C. Fach; Steven R. Kick

(57) ABSTRACT

A resettable breakaway apparatus may include: a housing having an aperture. A plunger may extend through the aperture, and the plunger may be movably coupled to the housing. The plunger may have a plunger head, and the plunger head may be movable between a first position, in which the plunger head is relatively farther from the housing, and a second position, in which the plunger head is relatively closer to the housing. A tensioner may tension or compress the plunger head in the first position. The apparatus may further include a receiver having a receiver head. The housing may be coupled to a first object and the receiver may be coupled to a second object, and the apparatus may be configured to removably couple the objects together by engaging the plunger head with the receiver head so that the plunger head may be positioned between the first and second position.

19 Claims, 12 Drawing Sheets

(56) References Cited

U.S. PATENT DOCUMENTS

| | | | | |
|---|---|---|---|---|
| 7,785,233 | B1 * | 8/2010 | Moore | A63K 3/043<br>482/17 |
| 9,427,612 | B1 * | 8/2016 | Swanson | A63B 21/16 |
| 2004/0250498 | A1 * | 12/2004 | Seel | A63K 3/046<br>52/698 |
| 2006/0249095 | A1 | 11/2006 | Godges et al. | |
| 2013/0174794 | A1 * | 7/2013 | Casiello | A01K 15/027<br>119/705 |
| 2013/0187018 | A1 * | 7/2013 | Canfield | F16M 13/02<br>248/219.4 |
| 2015/0114308 | A1 * | 4/2015 | Dolphin | A63K 3/04<br>119/705 |

* cited by examiner

RESETTABLE BREAKAWAY APPARATUS

CROSS REFERENCE TO RELATED APPLICATIONS

This application claims priority to and the benefit of the filing date of U.S. Provisional Application No. 62/851,764, filed on May 23, 2019, entitled "RESETTABLE BREAKAWAY APPARATUS", which is hereby incorporated by reference in its entirety.

FIELD OF THE INVENTION

This patent specification relates to the field of frangible barriers. More specifically, this patent specification relates to resettable breakaway apparatus which may be used to form a frangible barrier.

BACKGROUND

In the cross-country phase of the Olympic equestrian sport of eventing, a horse and rider pair traverse a predetermined track along which obstacles are placed that the pair must successfully negotiate (jump). On occasion it is possible for the horse and/or rider to make a mistake and "miss" the jump. An injurious result is possible. In particular, the impact of the horse at the obstacle can lead to a rotational fall whereas the horse and rider rotate over the obstacle with the horse potentially landing on its head or neck, or on its back and on top of the rider. To mitigate such falls, designers have begun to implement frangible fences at the high levels of competition and training. The safety concept is to minimize the amount of horse and rider momentum that can be converted to rotational momentum when an impact occurs by allowing the obstacle to "break" when an impact exceeds a preset limit. The current state of the art for frangible fences employs "fusible link" mechanisms employed on each side of an obstacle. The intent is for the apparatus to only break when the horse and rider meet the obstacle with an impact sufficient to result in a rotational fall. For all other impacts, the apparatus should not break (e.g., glancing hoof strikes). As an example of the current technology: a log is held above the ground on top of pins that are inserted into support structures. The pins break if there is sufficient downward impact to the log, causing the log to drop. Other devices used for frangible fences include deformable logs and MIM™ clips. Many horse and rider pairs approach a cross country obstacle during the obstacle's life. The goal is to always jump over the obstacle without horse or rider touching any component. In reality horses can stop in front of a jump with some frontal impact, have glancing hoof blows (either front or rear hoof) as they pass over, or some other impact that would not produce a rotational fall. Each of the current implementations are subject to fatigue caused by impacts that do not lead to rotational falls. The resulting fatigue may then cause the apparatus to break in unintended circumstances. Unintended breaks are not desirable as they can unfairly penalize a horse and rider during competition, and they can lead to incorrect training of the horse.

Therefore, there exists a need for a novel resettable breakaway apparatus for use in the equestrian sport of eventing and other activities having a barrier in which participants must traverse across and/or over.

BRIEF SUMMARY OF THE INVENTION

A resettable breakaway apparatus is provided which may be employed in a frangible jump fence, so that the jump fence will only break for impacts greater that that dictated by a preset threshold. Additionally, the apparatus will always reset itself to its nominal configuration for impacts less than the breaking impact, and if the jump fence were to collapse it can be reset to the repeatable nominal configuration. The apparatus may be used in any similar application where an obstacle must withstand multiple impacts below a known threshold and must collapse or break away for impacts above this threshold.

In some embodiments, the apparatus may comprise a receiver and plunger, one or both of which may be spring loaded, and one of which is mounted to a structure, such as a jumpable fence, so that it presses against its opposing part that is mounted to the collapsible portion of an obstacle. A receiver and plunger pair may be mounted to each side of a collapsible structure such that the plunger is pushed into a portion of the receiver preferably by a tensioner under compression. The compression of the tensioner in the apparatus may be variable using an adjustment screw or other tensioner modulator in the apparatus so that the interface between the receiver and plunger breaks when a sufficient impulse is imparted to the obstacle (for example, when a horse impacts a fence). The necessary tensioners' compression is deterministic from the physical properties of the obstacle construction and placement. Once the correct compression is set in the field application using the adjustment screw then the apparatus yields non-destructively by the plunger being dislodged from the receiver given sufficient impact to the fence. The fence is then re-settable to its nominal configuration by re-engaging the plunger and receiver since there is no destruction or fatigue to the apparatus.

In some embodiments, a resettable breakaway apparatus may include: a housing having a first end and a second end, and an aperture may be disposed in the first end. A plunger may extend through the aperture, and the plunger may be movably coupled to the housing. The plunger may have a plunger head, and the plunger head may be movable between a first position, in which the plunger head is relatively farther from the housing, and a second position, in which the plunger head is relatively closer to the housing. The first position and second position may be in an axis of plunger movement. A tensioner may be configured to tension or compress the plunger head in the first position with an amount of force. The apparatus may further include a receiver having a receiver head. The housing may be coupled to a first object and the receiver may be coupled to a second object, and the apparatus may be configured to removably couple the first and second objects together by engaging the plunger head with the receiver head so that the plunger head may be positioned between the first position and the second position. Preferably, the plunger head and receiver head may be engaged together so as to resist movement of the plunger head relative to the receiver head in a direction substantially perpendicular to the axis of plunger movement.

In further embodiments, a resettable breakaway apparatus may include a cross beam and a cross beam support, and the apparatus configured to removably couple the cross beam to the cross beam support. The apparatus further including a housing having a first end and a second end, and an aperture may be disposed in the first end. The housing may be coupled to a first object, and the first object may be either the cross beam or cross beam support. A plunger may extend through the aperture, and the plunger may be movably coupled to the housing. The plunger may have a plunger head, and the plunger head may be movable between a first position, in which the plunger head is relatively farther from the housing, and a second position, in which the plunger head is relatively closer to the housing. A tensioner may be configured to tension or compress the plunger head in the first position with an amount of force. A receiver, having a receiver head and a receiver base, may be coupled to a second object, and the second object may be either the cross beam or cross beam support and may not be the first object. The first object and second object may be removably coupled together by engaging the plunger head with the receiver head so that the plunger head is positioned between the first position and the second position.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

Figure 1:
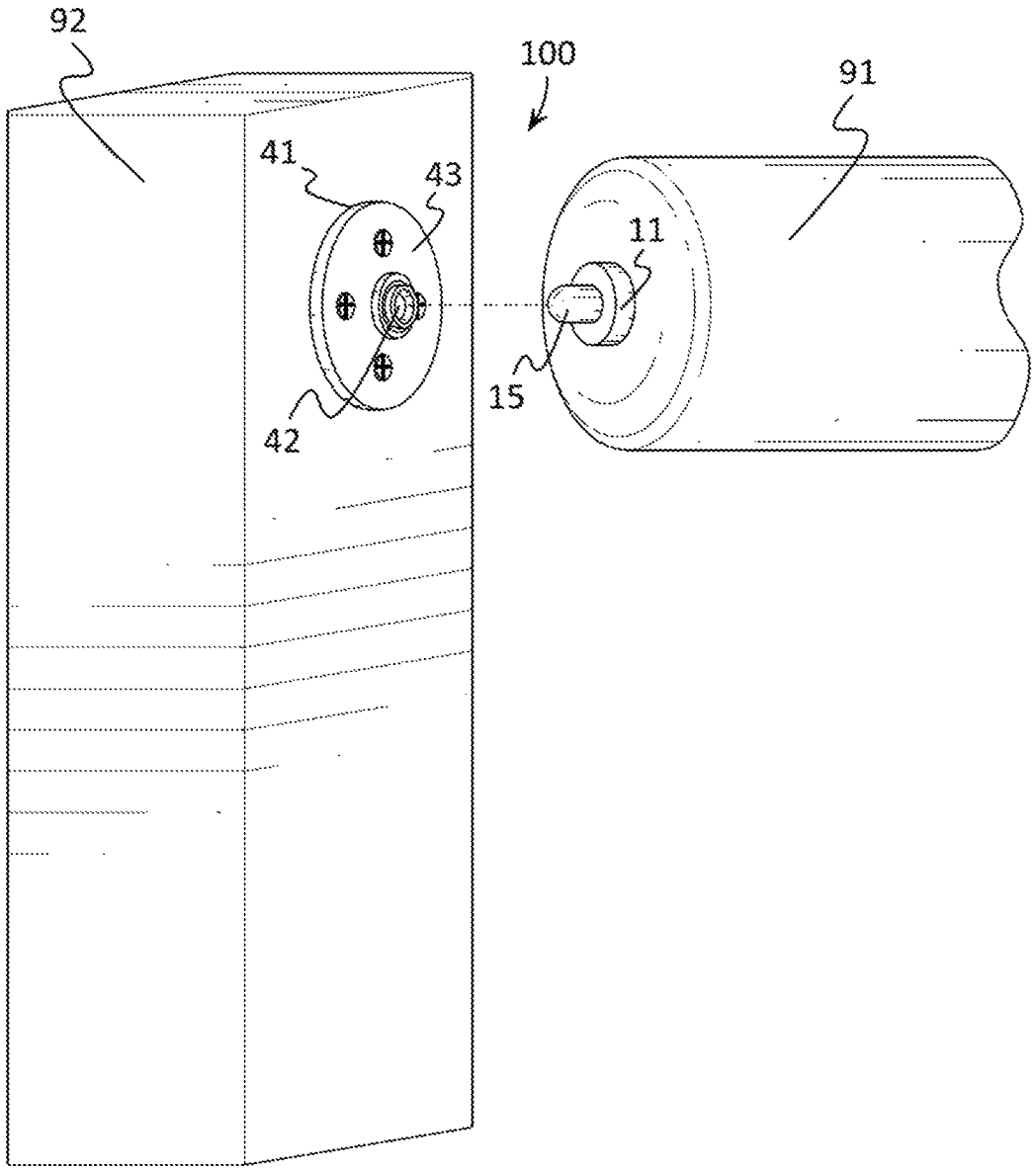
FIG. 1—FIG. 1 depicts a perspective view of an example of a resettable breakaway apparatus according to various embodiments described herein.
Figure 2:
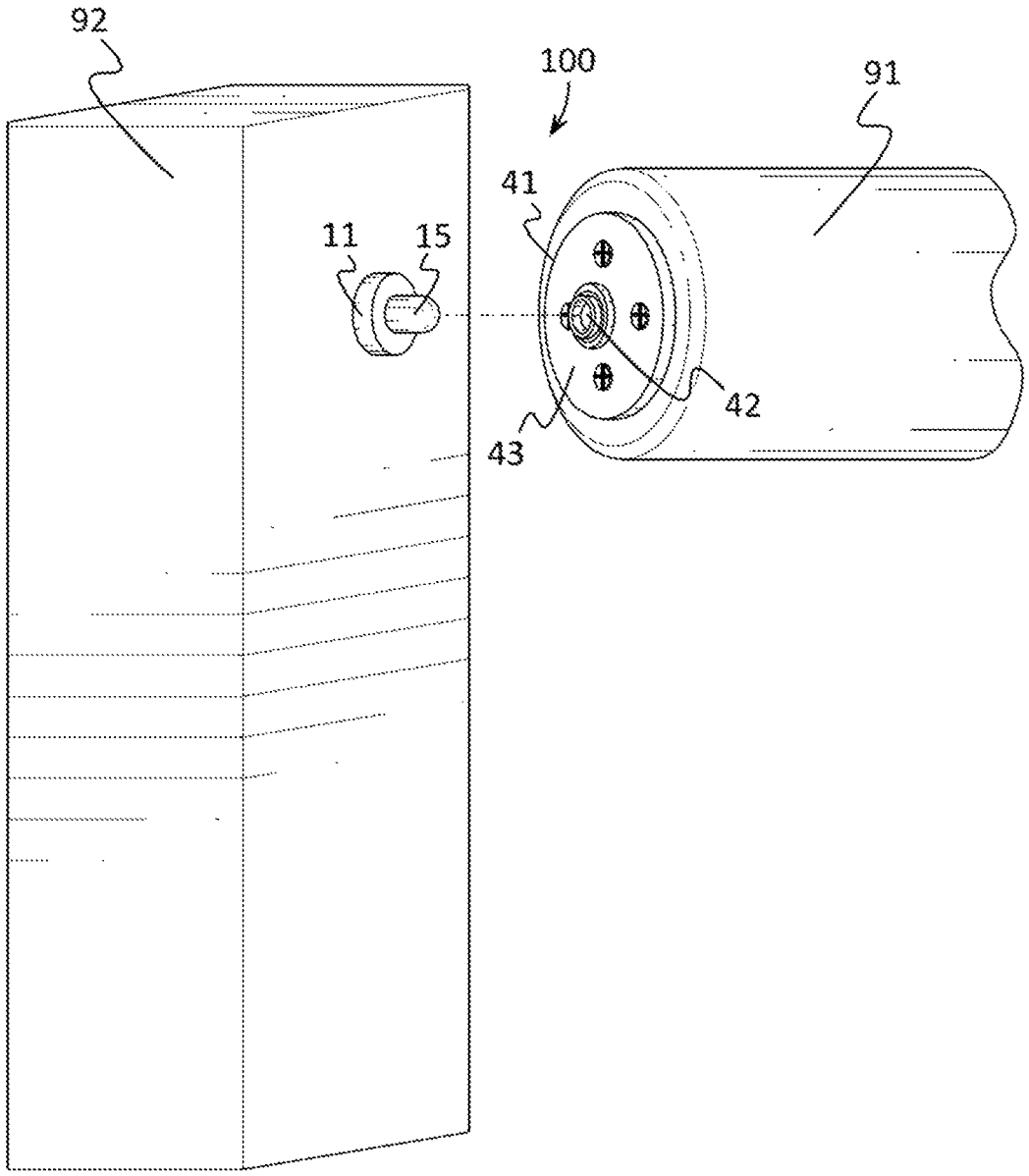
FIG. 2—FIG. 2 illustrates a perspective view of another example of a resettable breakaway apparatus according to various embodiments described herein.
Figure 3:
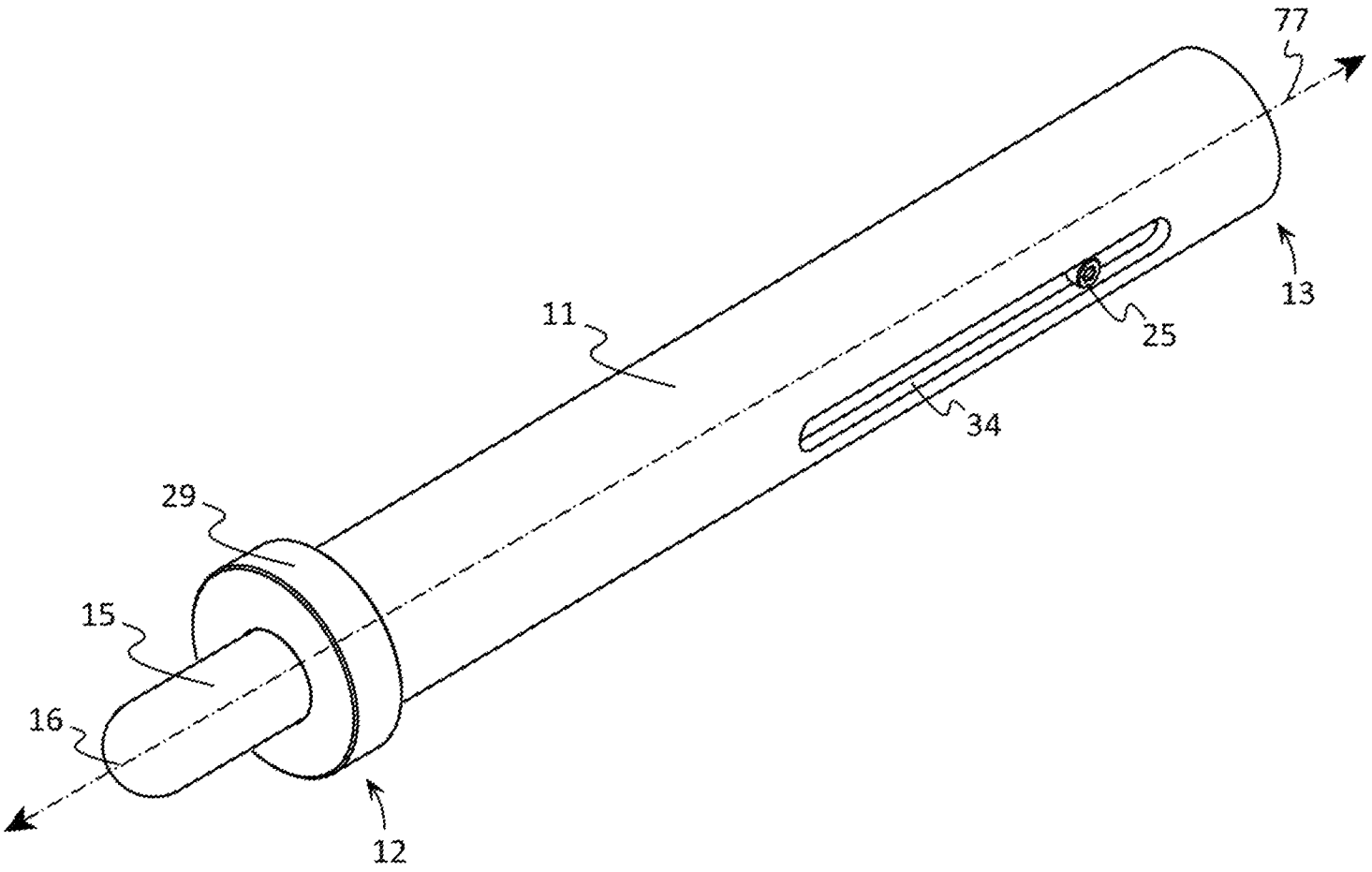
FIG. 3—FIG. 3 shows a perspective view of an example of a plunger and housing according to various embodiments described herein.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion (is this sentence correct/required?). Nevertheless, the specification and claims should be read with the understanding that such combinations are entirely within the scope of the invention and the claims.

For purposes of description herein, the terms "upper", "lower", "left", "right", "rear", "front", "side", "vertical", "horizontal", and derivatives thereof shall relate to the invention as oriented in FIGS. 1-15. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first", "second", etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new resettable breakaway apparatus is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1, 2, 4, and 15 illustrate examples of a resettable breakaway apparatus ("the apparatus") 100 according to various embodiments. In some embodiments, the apparatus 100 may comprise a housing 11 having a first end 12 and a second end 13, and an aperture 14 may be disposed in the first end 12. A plunger 15 may extend through the aperture 14, and the plunger 15 may be movably coupled to the housing 11. The plunger 15 may have a plunger head 16, and the plunger head 16 may be movable between a first position 71, in which the plunger head 16 is relatively farther from the housing 11, and a second position 72, in which the plunger head 16 is relatively closer to the housing 11. The first position 71 and second position 72 may be in an axis of plunger movement 77. A tensioner 17 may be configured to compress the plunger head 16 in the first position 71 with an amount of force. The apparatus 100 may further include a receiver 41 having a receiver head 42. The housing 11 may be coupled to a first object and the receiver 41 may be coupled to a second object, and the apparatus 100 may be configured to removably couple the first and second objects together by engaging the plunger head 16 with the receiver head 42 so that the plunger head 16 may be positioned between the first position 71 and the second position 72. Preferably, the plunger head 16 and receiver head 42 may be pressed together so as to resist movement of the plunger head 16 relative to the receiver head 42 in a direction substantially perpendicular to the axis of plunger movement 77.

The apparatus 100 may be configured to removably couple two objects together so that the two objects may remain coupled together until an impulse above a desired threshold is applied to the objects. For example, the apparatus 100 may be used to removably couple a cross beam 91 and a cross beam support 92 together, such as which may be used to form equestrian jump fences 90 or hurdles, human cross-country jump fences or hurdles, or any other objects. Typically, a jump fence may include a generally horizontally oriented cross beam 91 which may be coupled to two generally vertically oriented cross beam supports 92 so that the cross beam 91 is supported a desired distance above a ground surface by the cross beam supports 92. Preferably, the apparatus 100 may be used to removably couple a cross beam support 92 to an end of a cross beam 91 of a jump fence 90. It should be understood that cross beams 91 and cross beam supports 92 may be configured in any shape and size. Additionally, cross beams 91 and cross beam supports 92 may be made from wood, plastic, fiberglass, or any other material.

In preferred embodiments, an apparatus 100 may be applied to each side of an obstacle to provide for collapse of the obstacle when the obstacle is struck with an impulse exceeding a pre-determined threshold, and each apparatus 100 may comprise a plunger 15, a receiver 41, and one or more preferably adjustable tensioners 17 that together hold the obstacle in its nominal configuration until an impact greater than a known and adjustable threshold causes the spring tensioned apparatus 100 to release its hold. The apparatus 100 is typically employed on each side of the obstacle so that the release of one side causes the opposite side to also release, allowing the obstacle to collapse. However, it should be understood that in other applications, one, three, four, or more apparatuses 100 may be used with an obstacle.

Implementations of structures used as obstacles for equestrian eventing competitions and training utilize mechanisms that yield frangible structures, i.e. structures that break and fall out of the horses' trajectory when the horse impacts the structure with sufficient impulse. Obstacles need to collapse for impacts exceeding an impulse greater than 500 to 1000 newton-seconds (also of 250 Joules at the front rail of a fence and 400 Joules for the back rail of an oxer fence) to significantly reduce the potential for rotational falls. The precise impulse magnitude that causes collapse should be adjustable in the field and depends on parameters of fence design and placement. The apparatus 100 described may be employed in cross-country fence construction by providing a break-away mechanism that is not destroyed when it yields, yields to impacts from any direction, resets itself to its nominal configuration after impacts below the yield threshold, and is easily reset to the nominal configuration once a yield occurs. In preferred embodiments, spring compression via tensioner 17 holds the frangible portion of the obstacle, such as a cross beam 91, against the fixed portion of the obstacle, such as a cross beam support 92 with deterministic and repeatable force.

In some embodiments as in FIG. 1, a receiver 41 may be coupled to a cross beam support 92 and a housing 11 may be coupled to an end of a cross beam 91 that is to be removably coupled to the cross beam support 92. The cross beam 91 and cross beam support 92 may be removably coupled together by engaging the plunger head 16 movably coupled to the housing 11 with the receiver head 42 that is coupled to the cross beam support 92 so that the plunger head 16 is positioned between the first position 71 and the second position 72. In further embodiments as in FIG. 2, a receiver 41 may be coupled to a cross beam 91 and a housing 11 may be coupled to an end of a cross beam support 92. The cross beam 91 and cross beam support 92 may be removably coupled together by engaging the plunger head 16 movably coupled to the housing 11 with the receiver head 42 that is coupled to the cross beam 91 so that the plunger head 16 is positioned between the first position 71 and the second position 72.

The apparatus 100 may comprise a housing 11 which may be coupled to a first object, such as a cross beam 91 or a cross beam support 92, that the apparatus 100 is configured to couple to a second object. A housing 11 may have a first end 12 that portions of the plunger 15 may extend from and a second end 13 which may be coupled to or positioned within portions of a first object. In preferred embodiments, all or the majority of the housing may be positioned within or recessed within the first object while portions of the plunger 15, including the plunger head 16 may extend out and away from the first object while the plunger head 16 is in the first position 71.

In some embodiments, a housing 11 may be configured with a generally elongated cylindrical shape. In other embodiments, a housing 11 may comprise an elongated rectangular prism shape, elongated triangular prism shape, elongated hexagonal prism shape, or any other shape and size, including combinations of shapes. A housing 11 may be made from or may comprise aluminum, steel alloys, other metal alloys, composite materials, such as carbon fiber, plastic, or any other substantially durable and rigid material.

The apparatus 100 may comprise a plunger 15 which may be movably coupled to the housing 11 so that the plunger 15 may be moved relative to the housing 11. In some embodiments, the housing 11 may comprise an aperture 14 disposed on or at the first end 13 and portions of the plunger 15 may extend through the aperture 14 so as to be able to move in and out of the housing 11 via the aperture 14. Preferably a plunger 15 may comprise an elongated shape, how ever, a plunger 15 may be configured in any shape and size. A plunger 15 may be made from or may comprise aluminum, steel alloys, other metal alloys, composite materials, such as carbon fiber, plastic, or any other substantially durable and rigid material.

The plunger 15 may comprise a plunger head 16 which may form all or the portions of the plunger 15 which may contact and engage with the receiver head 42 of the receiver 41. Generally, a plunger head 16 may form the portions of the plunger 15 that may be distal to the second end 13. A plunger head 16 may be configured in any shape and size.

In some embodiments, and as perhaps best shown in FIGS. 3-6B, a plunger head 16 may comprise a plunger protruding surface 32 which may protrude away from the housing 11. In preferred embodiments, a plunger protruding surface 32 may protrude away from the housing 11 by having a convex curved or rounded shape relative to the housing 11. In other embodiments, a plunger protruding surface 32 may protrude away from the housing 11 by having a convex bell shape, a protruding triangular shape, a protruding cone shape, or any other shape which may protrude away from the away from the housing 11 so that when the plunger head 16 is engaged to a receiver head 42, the plunger protruding surface 32 of the plunger head 16 may act as a male element which may extend into a female or recessed shaped receiver head 42.

Figure 12:
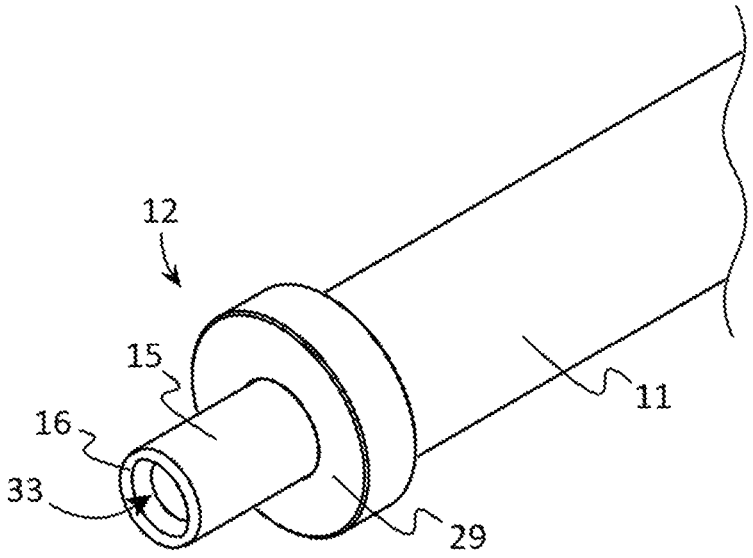
FIG. 12—FIG. 12 shows a perspective view of another example of a plunger and housing according to various embodiments described herein.

In some embodiments, and as perhaps best shown in FIG. 12, a plunger head 16 may comprise a plunger depressed surface 33 may be depressed or recessed towards the housing 11 by being depressed or recessed into the plunger 15. In preferred embodiments, a plunger depressed surface 33 may be depressed towards the housing 11 by having a concave curved or rounded shape relative to the housing 11. In other embodiments, a plunger depressed surface 33 may be depressed towards the housing 11 by having a concave bell shape, a recessed triangular shape, a recessed cone shape, or any other shape which may be depressed towards the housing 11 by being depressed into the plunger 15 so that when the plunger depressed surface 33 of the plunger head 16 is engaged to a receiver head 42, such as a receiver head 42 shown in FIG. 13, the plunger head 16 may act as a female element into which a male or protruding shaped receiver head 42 may be received.

Figure 6A:
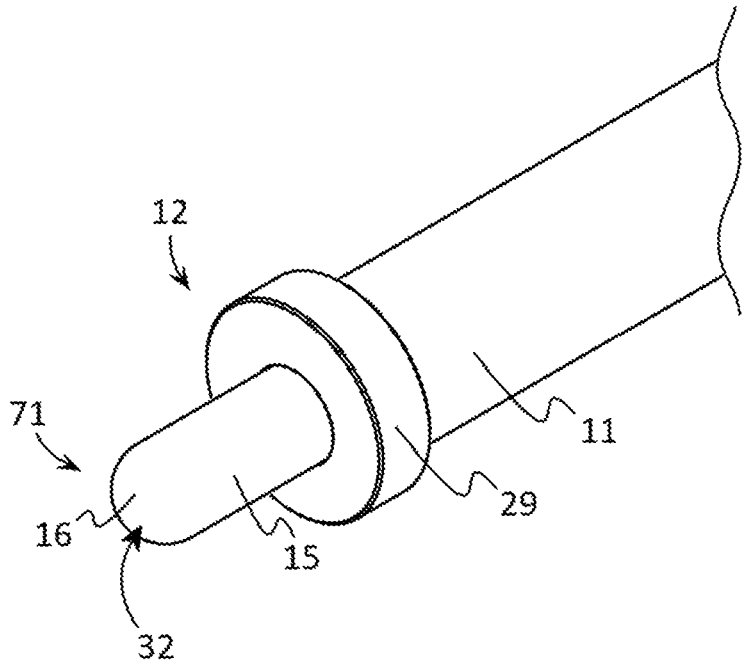
FIG. 6A-FIG. 6A shows a perspective view of an example of a plunger in a first position according to various embodiments described herein.
Figure 6B:
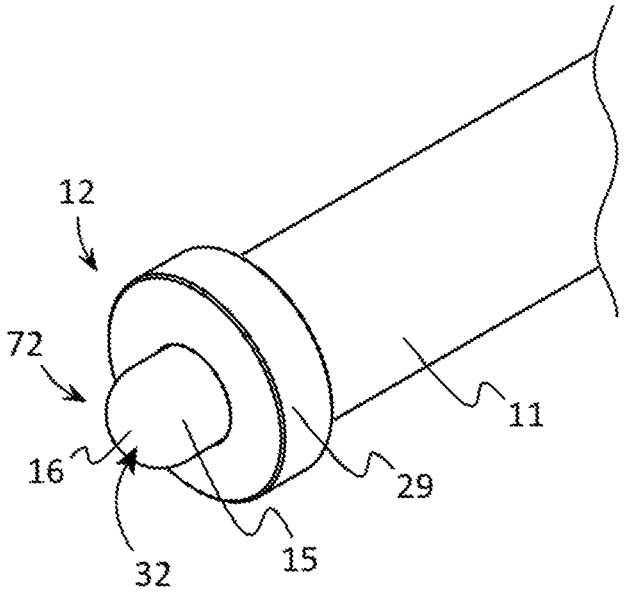
FIG. 6B-FIG. 6B shows a perspective view of an example of a plunger in a second position according to various embodiments described herein.
Figure 7:
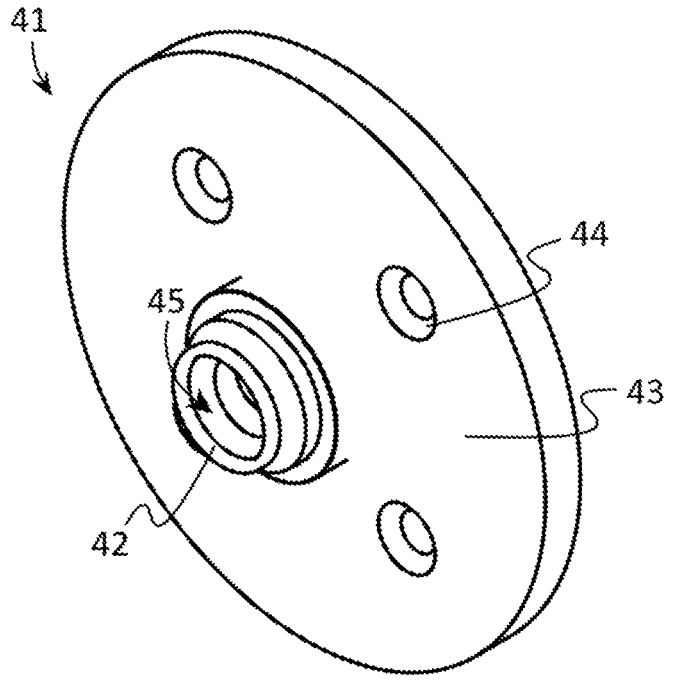
FIG. 7-FIG. 7 depicts a perspective view of an example of a receiver according to various embodiments described herein.
Figure 8:
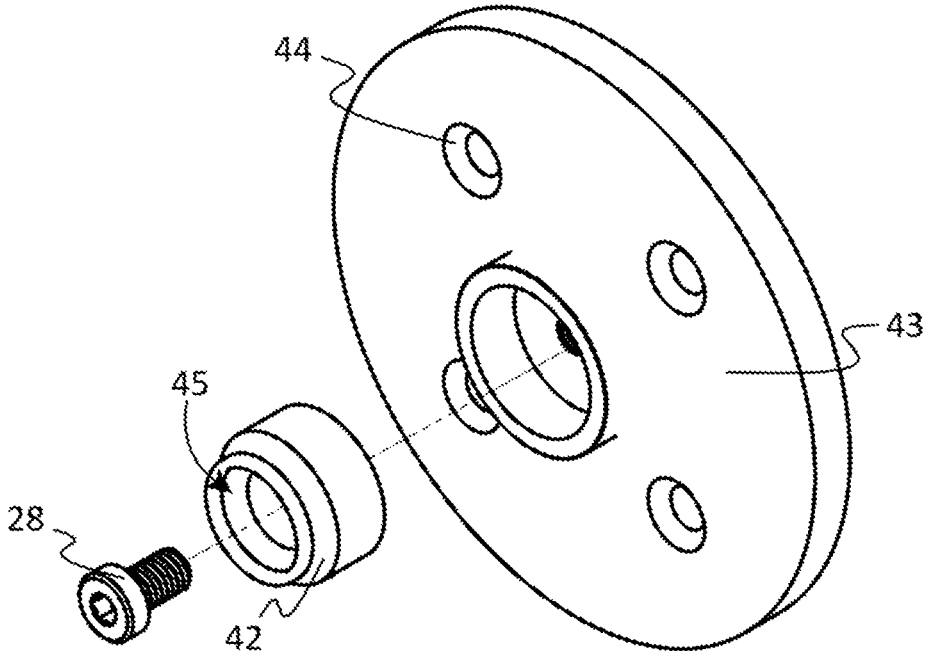
FIG. 8-FIG. 8 illustrates a perspective exploded view of an example of a receiver according to various embodiments described herein.

The plunger 15 may be movably coupled to the housing 11 so that the plunger 15, and therefore the plunger head 16, may be moved into and between a first position 71 and a second position 72 as perhaps best shown by FIGS. 6A and 6B. In the first position 71 the plunger head 16 is relatively farther from the housing 11, and in the second position 72 the plunger head is relatively closer to the housing 11. Preferably, the first position 71 and second position 72 may be in an axis of plunger movement 77 which optionally may extend between the first end 12 and second end 13 of the housing 11. The plunger 15 may be movably coupled to the housing 11 so that portions of the plunger 15 may move in and out of the housing 11 along the axis of plunger movement 77.

Figure 4:
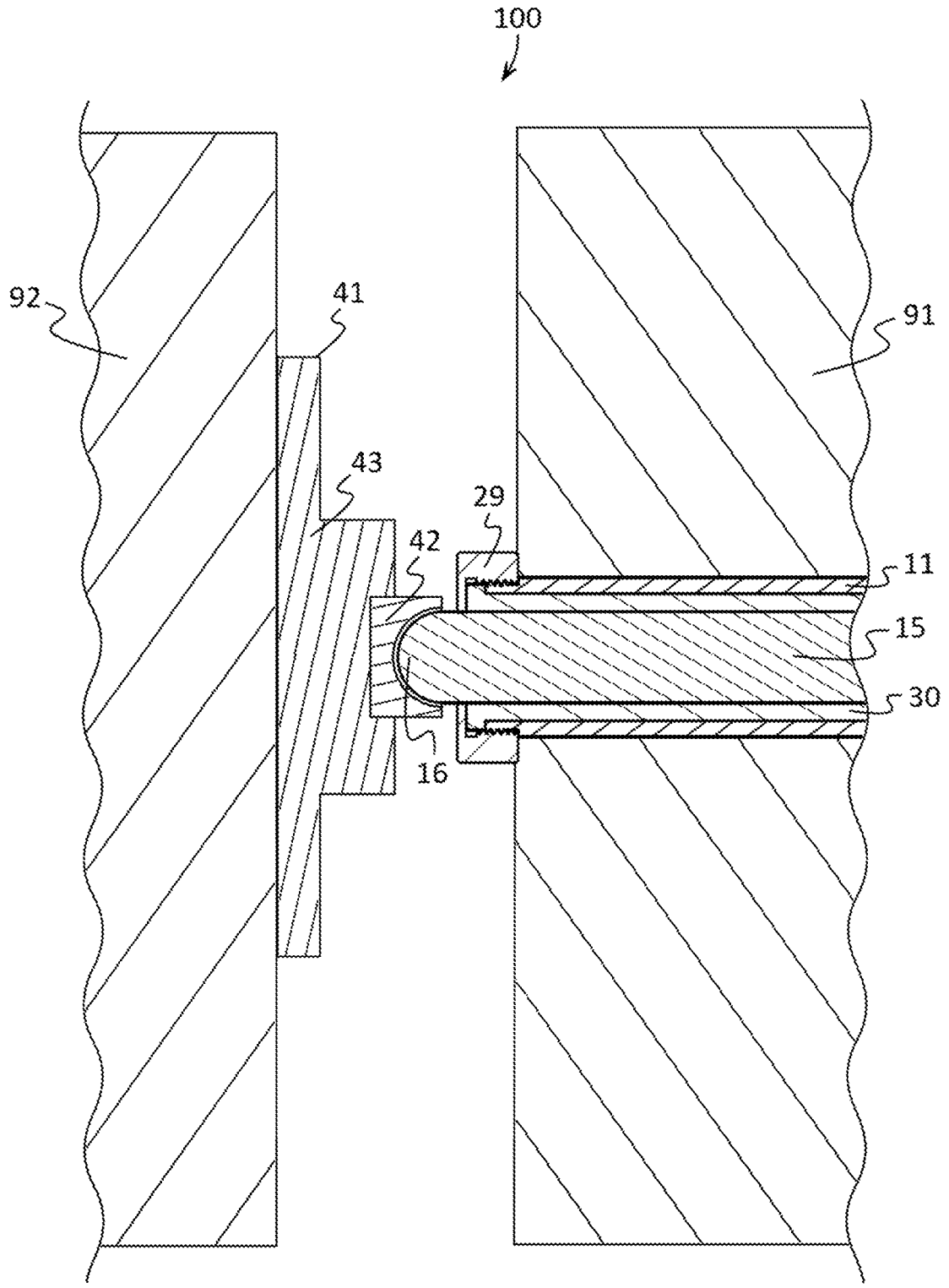
FIG. 4—FIG. 4 depicts a sectional elevation view of an example of a resettable breakaway apparatus according to various embodiments described herein.
Figure 5:
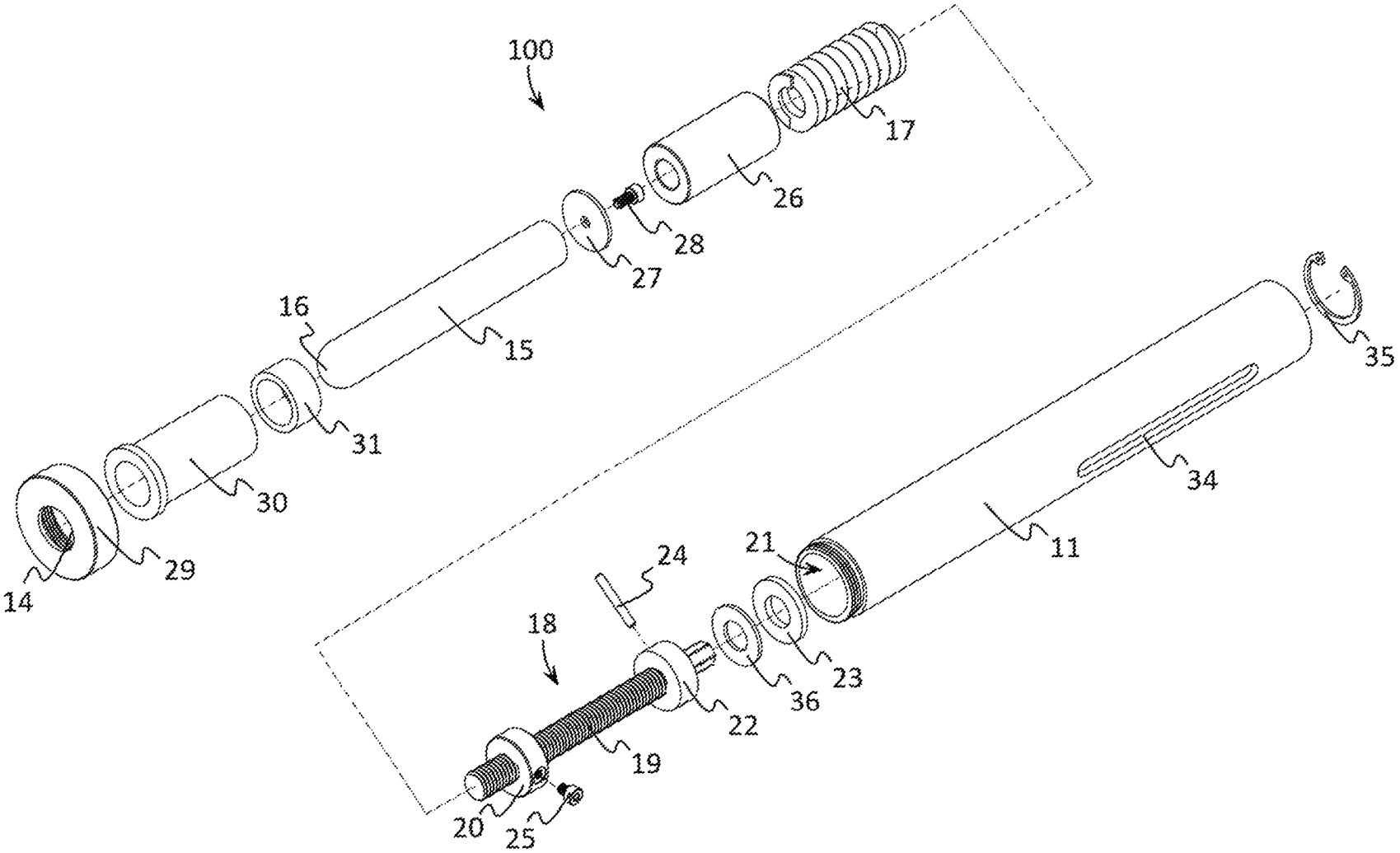
FIG. 5-FIG. 5 illustrates a perspective exploded view of some example elements or components which may be used to movably couple a plunger to a housing according to various embodiments described herein.

The apparatus 100 may comprise a tensioner 17 which may be configured to compress the plunger head 16 in the first position 71 so that movement of the plunger head 16 out of the first position 71 towards the second position 72 may be resisted by the tensioner 17. In some embodiments, a tensioner 17 may comprise a comprise a spring, such as a coil spring as illustrated in FIGS. 4 and 5, which is an elastic object used to store mechanical energy and which may be made from out of spring steel, annealed steel which is hardened after fabrication, and non-ferrous metals including phosphor bronze, titanium, beryllium copper, or any other suitable material. In further embodiments, a tensioner 17 may comprise any type of spring such as a Tension/extension spring, Compression spring, Constant-force spring, Torsion spring, Variable spring, Coil spring, Flat spring, Machined spring, Serpentine spring, Cantilever spring, Hairspring or balance spring, Leaf spring, V-spring, Belleville washer or Belleville spring, Gas spring or gas piston, Hydraulic spring or hydraulic piston, Mainspring, Negator spring, Progressive rate coil springs, Spring washer, Torsion spring, Wave spring, Rubber band, bungee cord, foam pad or other non-metallic elastic material, or any other material or device which is suitable for compressing a plunger 15 and its plunger head 16 away from the housing 11.

In some embodiments, the apparatus 100 may comprise a tensioner modulator 18 (FIG. 5) which may be configured to control the amount of tension or compression force that a tensioner 17 may exert on the plunger 15 to tension or compress the plunger head 16 in the first position 71. In preferred embodiments, a tensioner modulator 18 may comprise a tensioner body 19 and a tensioner head 20 which may be repositioned at various positions on the tensioner body 19. A tensioner 17 may rest against the tensioner head 20 (directly or indirectly) so that by repositioning the tensioner head 20, relative to the first end 12 and the second end 13, the load or pre-load of the tensioner 17 may be adjusted. For example, by positioning the tensioner head 20 on the tensioner body 19 so that it is relatively closer to the first end 12 and plunger 15, the tensioner 17 may be compressed and pre-loaded to exert a greater amount of force on the plunger 15 to tension or compress the plunger head 16 in the first position 71 with a greater amount of force than if the tensioner head 20 is positioned on the tensioner body 19 so that it is relatively farther from the plunger 15 and first end 12 (closer to the second end 13). In other embodiments, a tensioner modulator 18 may comprise any other method or device for controlling or modulating the amount of tension or compression force that a spring may exert, including an adjustable Gas spring or gas piston, and an adjustable Hydraulic spring or hydraulic piston.

FIG. 5 illustrates some example elements or components which may be used to enable a plunger 15 to be movably coupled to a housing 11. It should be understood that the elements or components of FIG. 5 are exemplary in nature and that any other type of elements or components may be used to enable a plunger 15 to be movably coupled to a housing 11 between a first position 71 and a second position 72 and to enable the plunger 15 to resist being moved out of the first position 71.

In some embodiments, the apparatus 100 may comprise a housing 11 having a relatively cylindrical cavity 21 a tensioner modulator 18 may be positioned within the cavity 21 proximate to the second end 13. The tensioner modulator 18 may include a tensioner brace 22 which may be fixedly coupled to the tensioner body 19. The tensioner brace 22 may maintain the positioning of the tensioner body 19 within the cavity 21 such as by being coupled to the housing 11 or by resting against the housing 11 or by resting against one or more objects coupled to the housing 11, such as a snap ring 35 or other fastener, housing washers 23 (preferably made of metal to act as a steel retaining washer), rotating bearings 36 (preferably made of a low friction material to facilitate rotation), spacers, etc.

In some embodiments, a tensioner brace 22 may be coupled to a tensioner body 19 by being integrally formed together, via threading, pin fastener 24, heat bonding or welding, or any other suitable coupling method. A tensioner head 20 may comprise any object which may be re-positionably coupled to the tensioner body 19. Preferably, a tensioner head 20 may be threadedly coupled to a tensioner body 19, so that by rotating the tensioner head 20 relative to the tensioner body 19 the positioning of the tensioner head 20 may be changed, and its positioning may be fixed via a control screw 25 or any other removable coupling. Optionally, a housing 11 may comprise a cutout 34 which may be shaped to receive the head of control screw 25 so that the head of control screw 25 may move within the cutout 34 towards and away from the first end 12 and second end 13. The head of control screw 25 may slide back and forth within this cutout 34 which may force the tensioner head 20 to slide along the tensioner body 19 length.

A tensioner 17 may exert tension or compression against the plunger 15 and tensioner modulator 18, such as by resting against a tensioner head 20, directly or indirectly to resist movement of the plunger 15 and therefore resist movement of the plunger head 16 out of the first position 71. For example, a spacer 26 and a plunger washer 27, the plunger washer 27 coupled to the plunger 15 via a screw 28 or other coupling method, may be positioned between the plunger 15 and tensioner modulator 18 to indirectly transfer tension or compression from the tensioner 17 to the plunger 15. A spacer 26 may be configured to accommodate different tensioner 17 lengths. Longer tensioners 17 would require a shorter spacer 26. By varying the tensioner 17 length the associated spring constant may be varied to accommodate different applications.

A housing cap 29 may be removably coupled to the housing 11 via threading, by being integrally formed together, or with any other coupling method, and the housing cap 29 may comprise an aperture 14 through which portions of the plunger 15 may be received and may be moved through as the plunger is moved between the first 71 and second 72 positions. Optionally, one or more bearings 30, snubbers 31, or other movement restricting devices may be in contact with the plunger 15 in order to maintain or restrict the movement of the plunger 15 to the axis of plunger movement 77 as the plunger is moved between the first 71 and second 72 positions. Note that the bearing 30 to plunger 15 interface is probably the most critical interface for a working mechanism. The bearing 30 material is chosen for a slippery engagement with the plunger 15, and the plunger 15 surface is carefully controlled also to make sure this interface has low friction. Optionally, the bearing 30 may be configured from linear bearing material (as depicted), or may comprise two or more ball bearing assemblies in races, or any other suitable device or method.

The apparatus 100 may comprise a receiver 41, having a receiver head 42, with which the plunger head 16 may be removably engaged. A receiver 41 may include a receiver base 43 to which a receiver head 42 may be coupled. Generally, a receiver base 43 may be configured to couple the receiver head 42 to objects, such as a cross beam 91 or a cross beam support 92. Preferably, a receiver base 43 may comprise a generally circular shape, however, a receiver base 43 may be configured in any shape and size. In some embodiments, a receiver base 43 may comprise one or more fastener apertures 44 through which fasteners, such as screws, bolts, rivets, etc., may be received and used to couple the receiver base 43 to an object. In other embodiments, any other suitable coupling method may be used to couple the receiver base 43 to an object. Preferably, a receiver base 43 may be made from or may comprise aluminum, steel alloys, other metal alloys, composite materials, such as carbon fiber, plastic, or any other substantially durable and rigid material.

In some embodiments, a receiver head 42 may be coupled to a receiver base 43 via a screw 28, rivet, or other fastener. In further embodiments, a receiver head 42 may be coupled to a receiver base 43 with heat bonding or welding, adhesive, by being integrally formed or molded together, or with any other coupling method or device.

The receiver 41 may comprise a receiver head 42 which may form all or the portions of the receiver 41 which may contact and engage with the plunger head 16 of the plunger 15. Generally, a receiver head 42 may form the portions of the receiver 41 that may be distal to the receiver base 43. A receiver head 42 may be configured in any shape and size.

In some embodiments, and as perhaps best shown in FIGS. 1, 2, 4, and 7-9, a receiver head 42 may comprise a receiver depressed surface 45 which may be depressed or recessed towards the receiver base 43 by being depressed or recessed into the receiver head 42. In preferred embodiments, a receiver depressed surface 45 may be depressed towards the receiver base 43 by having a concave curved or rounded shape relative to the receiver base 43. In other embodiments, a receiver depressed surface 45 may be depressed towards the receiver base 43 by having a concave bell shape, a recessed triangular shape, a recessed cone shape, or any other shape which may be depressed towards the receiver base 43 by being depressed into the receiver head 42 so that when the receiver depressed surface 45 of the receiver head 42 is engaged to a plunger head 16, the receiver head 42 may act as a female element into which a male or protruding shaped plunger head 16 may be received.

Figure 13:
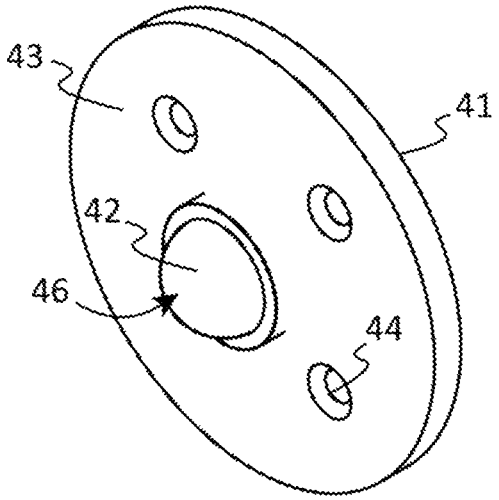
FIG. 13—FIG. 13 shows a perspective view of a further example of a receiver according to various embodiments described herein.

In some embodiments, and as perhaps best shown in FIG. 13, a receiver head 42 may comprise a receiver protruding surface 46 which may protrude away from the receiver base 43. In preferred embodiments, a receiver protruding surface 46 may protrude away from the receiver base 43 by having a convex curved or rounded shape relative to the receiver base 43. In other embodiments, a receiver protruding surface 46 may protrude away from the receiver base 43 by having a convex bell shape, a protruding triangular shape, a protruding cone shape, or any other shape which may protrude away from the receiver base 43 so that when the receiver head 42 is engaged to a plunger head 16, the receiver protruding surface 46 of the receiver head 42 may act as a male element which may extend into a female or recessed shaped plunger head 16.

Figure 9:
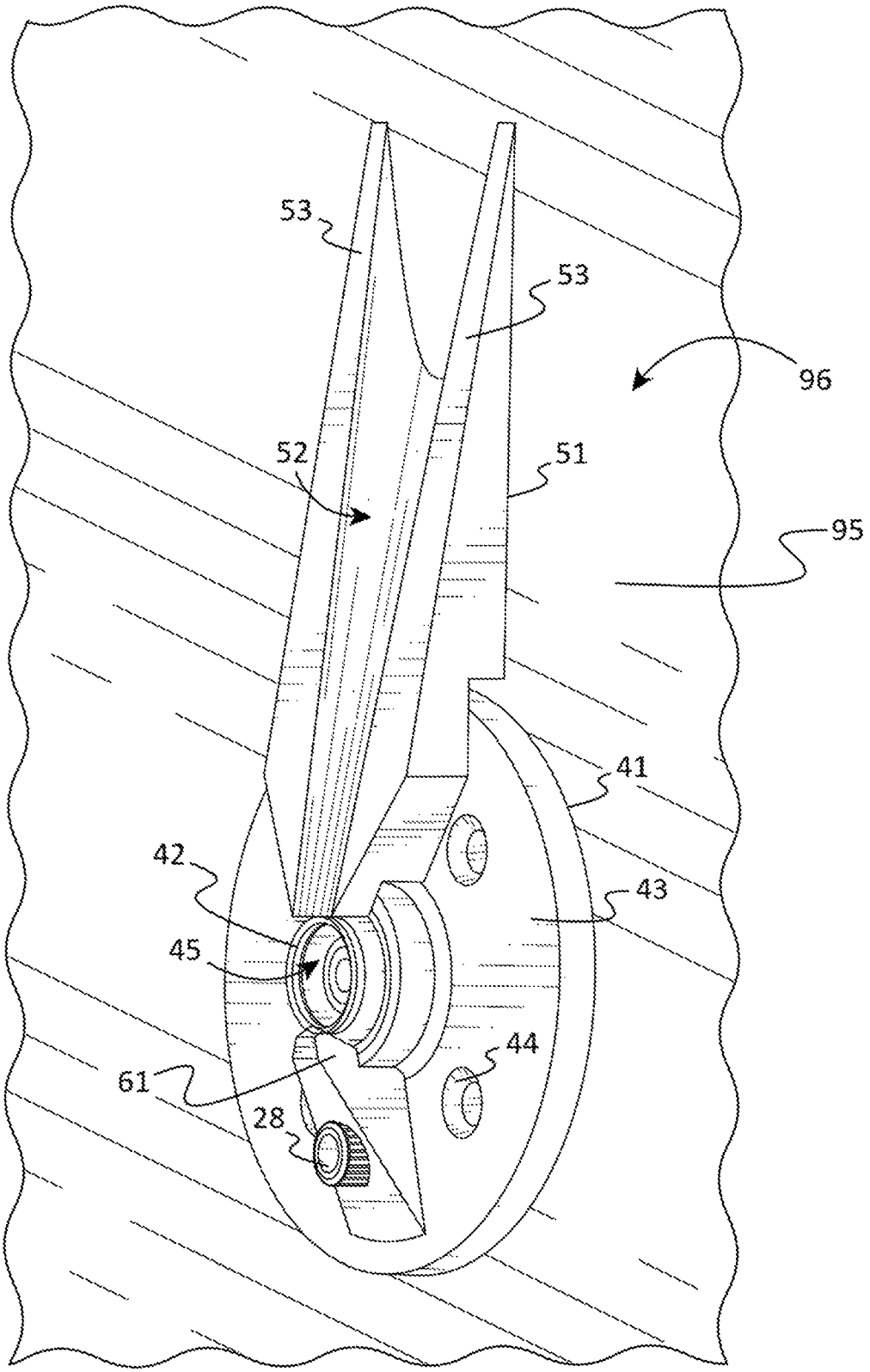
FIG. 9—FIG. 9 shows a perspective view of another example of a receiver according to various embodiments described herein.
Figure 10:
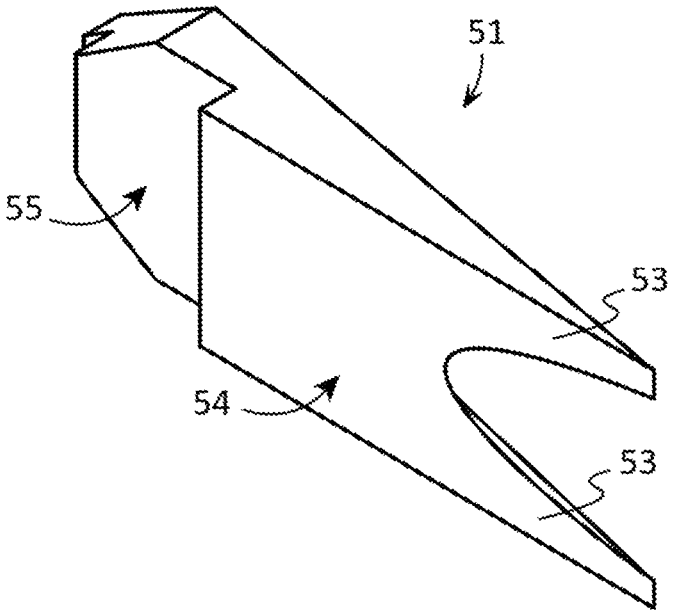
FIG. 10—FIG. 10 depicts a perspective view of the back of an example of a guide according to various embodiments described herein.

In some embodiments, and as shown in FIGS. 9 and 10, the apparatus 100 may comprise a guide 51 which may be coupled to the receiver 41 and/or to an object 95 that the receiver 41 may be coupled to. In preferred embodiments, a guide 51 may have a guide surface 52 which may extend between an object surface 96 that the guide 51 is coupled to and the receiver head 42. Generally, a guide 51 may be used to help guide the plunger head 16 into contact with the receiver head 42 by helping to compress the plunger 15 towards the second position as the plunger head 16 moves across the guide surface 52.

A guide 51 may be configured in any shape and size and may preferably be made from metal, such as a polished metal, low friction plastic, or other substantially rigid material that has a low frictional coefficient. A guide surface 52 may be configured in any shape and size which may be sloped, angled, or otherwise transition from an object surface 96 that the guide 51 is coupled to and the receiver head 42. A guide 51 may include an object mounting surface 54 and a receiver mounting surface 55. The object mounting surface 54 may contact an object surface 96 that the receiver 41 and guide 51 may be coupled to, while a receiver mounting surface 55 may contact portions of the receiver 41, such as the receiver base 43, that the guide 51 may be coupled to.

Preferably, a guide 51 may comprise one or more flanking arms 53 which may be positioned on each side of the guide surface 52. The flanking arms 53 may guide or funnel a plunger head 16 towards the guide surface 52 by preferably being raise above portions of the guide surface 52 to which the flanking arms 53 are coupled. For example, a guide 51 can be mounted in an appropriate orientation to facilitate re-setting of a cross beam 91 and cross beam support 92 as it may guide the plunger head 15 into contact with the receiver head 42.

Figure 11:
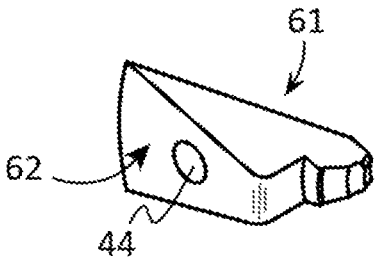
FIG. 11-FIG. 11 illustrates a perspective view of the back of an example of a support arm according to various embodiments described herein.

In some embodiments, and as shown in FIGS. 9 and 11, the apparatus 100 may comprise a support arm 61 which may be coupled to the receiver 41 below the receiver head 42. A support arm 61 may include mounting surface 62 which may contact portions of the receiver 41, such as the receiver base 43, that the support arm 61 may be coupled to and/or contact an object surface 96 that the receiver 41 may be coupled to. In further embodiments, a support arm 61 may be either below or above the receiver head 42 depending on if the receiver head 42 is mounted to a cross beam 91 or a cross beam support 92. In fact, it may be placed anywhere around the receiver 41, wherever a "stop" is needed. The support arm 61 may be mounted to the receiver base 43 and then this assembly would be mounted into the fence with the desired rotation of the assembly to place the "stop" where needed.

Generally, the support arm 61 may contact and support portions of the plunger 15 proximate to the plunger head 16 when the plunger head 16 and receiver head 42 are engaged together so that the receiver head 42 may help support the weight of the object that the housing 11 may be coupled to so that less weight is required to be supported by the receiver head 42. For example, a support arm 61 may be used when the housing 11 is coupled to a heavy log type cross beam 91 and may be coupled to the receiver 41 in an orientation that allows the weight of the cross beam 91 to rest on the side of the plunger 15, rather than have the tensioner 17 hold the weight of the cross beam 91.

Figure 14:
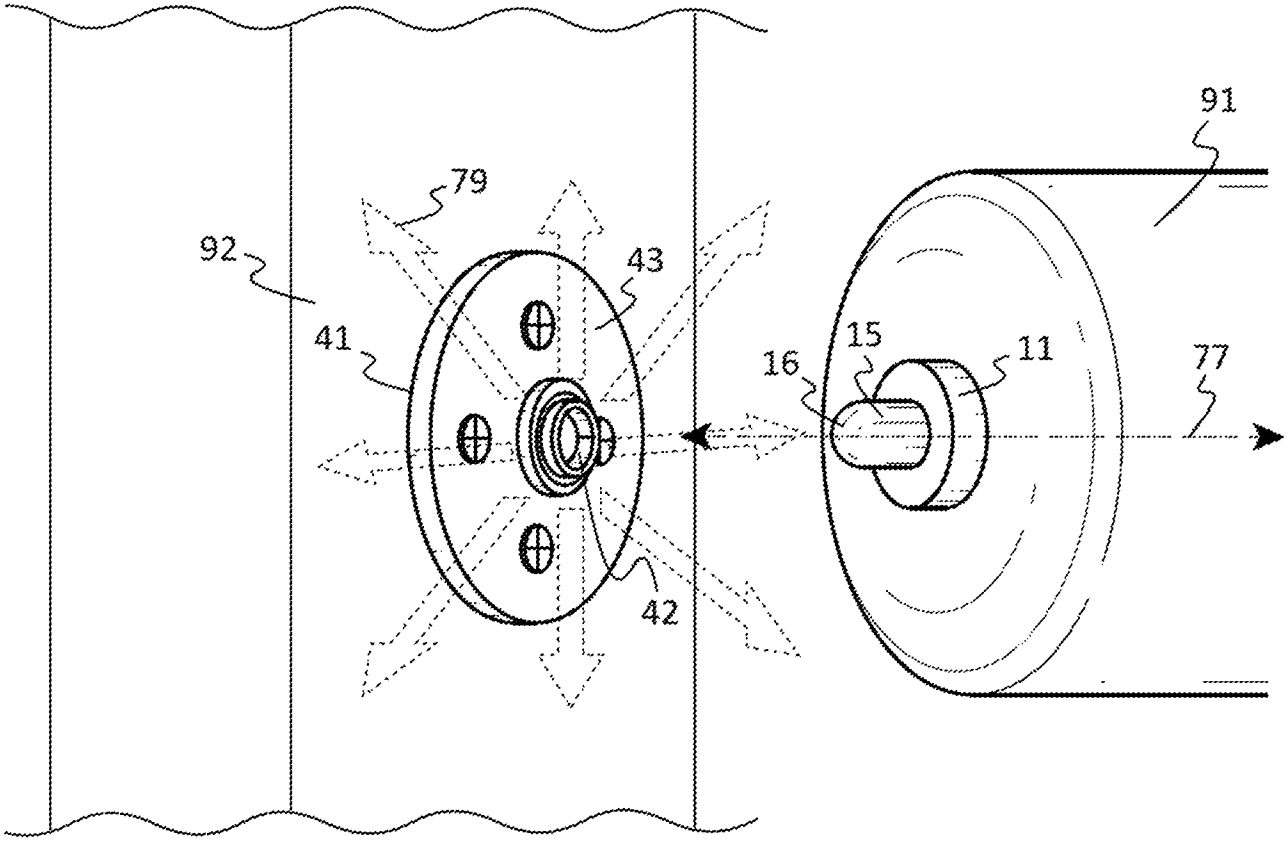
FIG. 14—FIG. 14 shows a perspective view of another example of a resettable breakaway apparatus according to various embodiments described herein.

As perhaps best shown in FIGS. 4 and 14, when the plunger head 16 is placed into contact with the receiver head 42, the plunger head 16 and receiver head 42 may be compressed together so as to resist movement of the plunger head 16 relative to the receiver head 42 in a direction substantially perpendicular to the axis of plunger movement 77. In FIG. 14 some examples of directions substantially perpendicular to the axis of plunger movement 77 are shown with the dashed arrows 79. However, the plunger head 16 and receiver head 42 may be compressed together so as to resist movement of the plunger head 16 relative to the receiver head 42 in one or more, such as any, direction substantially perpendicular to the axis of plunger movement 77.

A tensioner 17 may be configured to tension or compress the plunger head 16 in the first position 71 with an amount of force so that when the plunger head 16 is engaged with or to a receiver head 42 and positioned between the first 71 and second 72 position, the plunger head 16 and receiver head 42 may be compressed together so that the objects that the housing 11 and receiver 41 are coupled to, such as a cross beam 91 and a cross beam support 92, may be removably coupled together via the compression of the housing 11 and receiver 41. In preferred embodiments, a tensioner 17 may be configured to tension or compress the plunger head 16 in the first position 71 with an amount of force so that an impulse greater than 500 newton-seconds, and more preferably between 500 to 1000 newton-seconds, is required to move the plunger head 16 out of the first position 71. In further preferred embodiments, a tensioner 17 may be configured to tension or compress the plunger head 16 in the first position 71 with an amount of force so that an impact having energy greater than 100 Joules, such as between approximately 250 to 400 Joules or any amount specified by the competition regulating organization, is required to move the plunger head 16 out of the first position 71. For example, leading edges of jumps must break when struck with 250 Joules (or greater) and back rails of oxers must break when struck with 400 Joules (or greater).

In preferred embodiments, the apparatus 100 may be tailored to specific in-field application requirements using one or more of the following characteristics:

Spring constant: the apparatus 100 may comprise one or more spring type tensioners 17 with a specific spring constant that allows for a specific range in the apparatus' 100 holding force which preferably may be determined by the tensioner modulator 18 or other tension or compression adjusting method. Tensioners 17 with different spring constants provide for different ranges in the holding force.

Tensioner 17 length: similar to the spring constant, variations in tensioner 17 length provide for different ranges in the holding force.

Tensioner 17 configuration (e.g., springs within springs): the housing 11 accommodates variable spring configurations, stacked springs, spring within a spring, etc. This may be desirable for an obstacle implementation that requires a mild holding force when setting and re-setting an obstacle. Once the obstacle is in place, the stiffer spring is engaged when an impact occurs to the obstacle.

Off center mounting: the apparatus 100 may be mounted in any configuration with respect to the cross-sectional center of gravity of the collapsible portion (cross beam 91) of the obstacle. This gives the ability to vary the collapsing impulse as a function of impact vector (direction) and also gives the function of the collapsible portion automatically finding "home" when the fence is reset. Gravity would "spin" the log to the same orientation w.r.t. vertical when the fence is reset.

Figure 15:
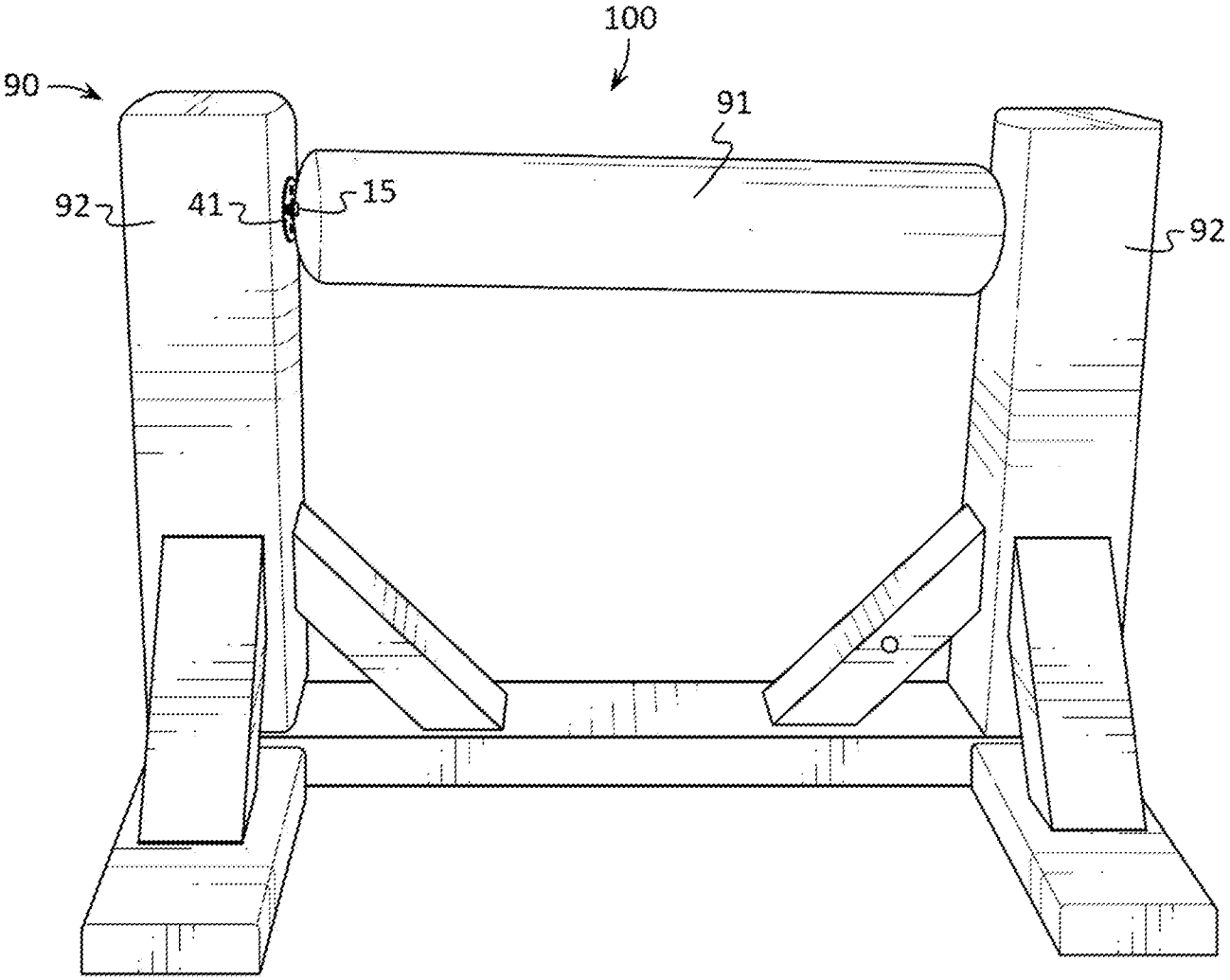
FIG. 15—FIG. 15 shows a perspective view of a further example of a resettable breakaway apparatus which optionally includes a jumpable fence having a cross beam and a cross beam support which may be removably coupled together via the engagement between a plunger and a receiver according to various embodiments described herein.

In further embodiments, the apparatus 100 may be used under the center of a table type of jump with a pivoting vertical structure element that supports the table top and to which the two receivers are attached at the bottom of the structure element (effectively FIG. 15 with a zero length log). This vertical element folds over (in the direction of the impact), allowing the hinged table top to collapse. In further embodiments, the apparatus 100 may include one center piece which is spherical and mounts to the vertical structure element that swings when the fence collapses. This ball would be retained in position by two opposing plunger assemblies that are shaped as in FIG. 12.

Profile of plunger surface 32, 33, and receiver surface 45, 46, (spherical, cone, bell, etc.): The shape of the plunger surface 32, 33, and of the receiver surface 45, 46, determine the time varying reaction of the apparatus to impacts. A spherical plunger surface 32, 33, and receiver surface 45, 46, shape will have a stiffer reaction initially to an impact, but will soften its reaction as the impact continues. This is helpful to distinguish hoof impacts which are short impulses vs. leg or body impacts which last longer. Conversely, a cone plunger surface 32, 33, and receiver surface 45, 46, shape provides uniform reaction throughout the impact duration. A bell shape plunger surface 32, 33, and receiver surface 45, 46, shape would provide some "give" to the initial impact, but increase resistance as the duration of impact increases. Very complex plunger surface 32, 33, and receiver surface 45, 46, shapes are considered for implementations requiring diverse reactions as a function of the direction of impact.

In some embodiments, a tensioner 17 may be used to tension or compress a movable plunger 15, receiver head 42, or both: The plunger 15 and/or receiver head 42 may be spring loaded as required by the specifics of the application.

When a horse impacts an obstacle, the impulse required to break the jump fence 90 obstacle (by dislodging a plunger 15 from its receiver 41 by moving the plunger head 16 out of the first position) ($I_{break}$) is defined by the equation:

$$I_{break} = k * X1 * \frac{X2}{V} + \int func(X1, k, \theta, t)dt + mass_{fence} * V$$

For example and in this equation k is the spring constant, X1 is the distance that the spring must compress to allow the obstacle to collapse, X2 is the diameter of the receiver orifice, V is the velocity imparted to the obstacle at the time of impact and θ is the contact angle between the plunger head 16 surfaces 32, 33, and receiver head 42 surfaces 45, 46.

While some exemplary shapes and sizes have been provided for elements of the apparatus 100, it should be understood to one of ordinary skill in the art that the housing 11, plunger 15, receiver 41, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the apparatus 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the apparatus 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatus 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the apparatus 100 may be coupled by being one of connected to and integrally formed with another element of the apparatus 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A resettable breakaway apparatus for removably coupling a first object to a second object, the apparatus comprising:

a housing having a first end and a second end, the housing coupled to the first object;

an aperture disposed in the first end of the housing;

a plunger extending through the aperture, the plunger movably coupled to the housing, the plunger having a plunger head with a curved plunger protruding surface, and the plunger head movable between a first position, in which the plunger head is relatively farther from the housing, and a second position, in which the plunger head is relatively closer to the housing, wherein the first position and second position are in an axis of plunger movement;

a tensioner configured to tension the plunger head in the first position with an amount of force; and a receiver coupled to the second object, the receiver having a receiver head and a receiver base, and the receiver head having a cured receiver depressed surface, wherein the first object is coupled to the second object solely by placing the curved plunger protruding surface of the plunger head in contact with the curved receiver depressed surface of the receiver head so that the plunger head is between the first position and second position and so that the curved plunger protruding surface is tensioned against the curved receiver depressed surface via the tensioner, and wherein contact between the curved plunger protruding surface and the curved receiver depressed surface is the only contact between the plunger and receiver.

2. The apparatus of claim 1, wherein the curved plunger protruding surface is convex curved in shape, and wherein the curved receiver depressed surface is concave curved in shape.

3. The apparatus of claim 1, wherein the tensioner comprises a spring.

4. The apparatus of claim 1, further comprising a tensioner modulator that is configured to control the amount of force that the tensioner is configured to tension the plunger head in the first position.

5. The apparatus of claim 4, wherein the tensioner modulator comprises a tensioner head that is movably coupled to a tensioner body, wherein the amount of force that the tensioner is configured to tension the plunger head increases as the tensioner head is positioned closer to the first end, and wherein the amount of force that the tensioner is configured to tension the plunger head decreases as the tensioner head is positioned closer to the second end.

6. The apparatus of claim 1, further comprising a support arm, the support arm coupled to the receiver around the receiver head.

7. The apparatus of claim 1, further comprising a guide, the guide having a guide surface, the guide surface extending between an object surface that the guide is coupled to and the receiver head.

8. The apparatus of claim 1, wherein an impact having energy greater than 250 Joules is required to move the plunger head out of the first position.

9. The apparatus of claim 1, further comprising a cross beam and a cross beam support, wherein the first object is the cross beam, and wherein the second object is the cross beam support.

10. The apparatus of claim 1, further comprising a cross beam and a cross beam support, wherein the first object is the cross beam support, and wherein the second object is the cross beam.

11. A resettable breakaway apparatus having a cross beam and a cross beam support, the apparatus configured to removably couple the cross beam to the cross beam support, and the apparatus comprising:

a housing having a cavity, a first end, and a second end, the housing coupled to a first object, and the first object selected from the cross beam and cross beam support;

an aperture disposed in the first end of the housing;

a plunger extending through the aperture, the plunger movably coupled to the housing, the plunger having a plunger head with a curved plunger depressed surface, and the plunger head movable between a first position, in which the plunger head is relatively farther from the housing, and a second position, in which the plunger head is relatively closer to the housing;

a tensioner configured to tension the plunger head in the first position with an amount of force, the tensioner positioned fully within the cavity of the housing;

a tensioner head located within the cavity of the housing so that the tensioner is positioned between the plunger and the tensioner head, the tensioner head configured to control the amount of force that the tensioner applies to the plunger head; and a receiver having a receiver head and a receiver base, the receiver coupled to a second object, the second object selected from the cross beam and cross beam support and the second object not being the first object, wherein the receiver head has a curved receiver protruding surface, wherein the first object is coupled to the second object solely by placing the curved plunger depressed surface of the plunder head in contact with the curved receiver protruding surface of the receiver head so that the plunger head is between the first position and second position and so that the curved plunger depressed surface is tensioned against the curved receiver protruding surface via the tensioner, and wherein contact between the curved plunger depressed surface and the curved receiver protruding surface is the only contact between the plunger and receiver.

12. The apparatus of claim 11, wherein the first object is the cross beam, and wherein the second object is the cross beam support.

13. The apparatus of claim 11, wherein the first object is the cross beam support, and wherein the second object is the cross beam.

14. The apparatus of claim 11, wherein the curved receiver protruding surface is convex curved in shape, and wherein the curved plunger depressed surface is concave curved in shape.

15. The apparatus of claim 11, wherein the tensioner comprises a spring.

16. The apparatus of claim 11, wherein the tensioner modulator comprises a tensioner head that is movably coupled to a tensioner body between a first position and a second position, wherein the amount of force that the tensioner is configured to tension the plunger head increases as the tensioner head is positioned closer to the first position, and wherein the amount of force that the tensioner is configured to tension the plunger head decreases as the tensioner head is positioned closer to the second position.

17. The apparatus of claim 11, further comprising a support arm, the support arm coupled to the receiver below the receiver head.

18. The apparatus of claim 11, further comprising a guide, the guide having a guide surface, the guide surface extending between an object surface that the guide is coupled to and the receiver head.

19. The apparatus of claim 11, wherein an impact having energy greater than 250 Joules is required to move the plunger head out of the first position.

* * * * *